US009809916B2

(12) United States Patent
Kim et al.

(10) Patent No.: US 9,809,916 B2
(45) Date of Patent: Nov. 7, 2017

(54) WASHING MACHINE WITH BALANCER AND CONTROL METHOD THEREOF

(71) Applicant: SAMSUNG ELECTRONICS CO., LTD., Suwon (KR)

(72) Inventors: Min Sung Kim, Yongin (KR); Jeong Hoon Kang, Seoul (KR); Dong Ha Jung, Seongnam (KR); Doo Young Rou, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 164 days.

(21) Appl. No.: 14/183,867

(22) Filed: Feb. 19, 2014

(65) Prior Publication Data

US 2015/0233037 A1 Aug. 20, 2015

(51) Int. Cl.

| | |
|---|---|
| ***D06F 35/00*** | (2006.01) |
| ***D06F 37/22*** | (2006.01) |
| ***D06F 37/30*** | (2006.01) |
| ***D06F 33/02*** | (2006.01) |

(52) U.S. Cl.

CPC ..... *D06F 35/007* (2013.01); *D06F 33/02* (2013.01); *D06F 35/005* (2013.01); *D06F 37/22* (2013.01); *D06F 37/225* (2013.01); *D06F 37/304* (2013.01); *D06F 2222/00* (2013.01); *D06F 2700/04* (2013.01)

(58) Field of Classification Search

CPC .... D06F 37/225; D06F 35/005; D06F 35/007; D06F 37/22; D06F 2222/00

See application file for complete search history.

(56) References Cited

U.S. PATENT DOCUMENTS

2008/0172805 A1* 7/2008 Na ..... D06F 35/007 8/159
2010/0031451 A1* 2/2010 Bae ..... D06F 33/02 8/159

FOREIGN PATENT DOCUMENTS

| | | | | |
|---|---|---|---|---|
| EP | 2154286 | | 2/2010 | |
| EP | 2824232 | | 1/2015 | |
| KR | 1020080037428 | * | 4/2008 | ..... D06F 37/22 |
| WO | WO2011/025324 | | 3/2011 | |
| WO | WO2013/161251 | | 10/2013 | |

OTHER PUBLICATIONS

Machine translation of KR 10-2008-0037428, no date.*
Partial European Search Report, dated Jun. 24, 2015, in corresponding European Application No. 15154708.0 (6 pp.).
Decision on Grant issued on Jun. 20, 2016 in corresponding European Patent Application No. 15 154 708.0.

* cited by examiner

*Primary Examiner* — Joseph L Perrin
(74) *Attorney, Agent, or Firm* — Staas & Halsey LLP

(57) ABSTRACT

Disclosed herein are a washing machine with a balancer to counterbalance unbalanced load produced during rotation of a drum and a control method thereof. The washing machine having a balancer to counterbalance unbalanced load produced during rotation of the drum seats a mass in a groove in the balancer before rotation of the drum possibly producing unbalance as in the spin-drying cycle begins, thereby efficiently maintaining balance of the drum. Accordingly, vibration in the drum may be reduced and product liability incident due to touch of the frame may be prevented.

19 Claims, 15 Drawing Sheets

WASHING MACHINE WITH BALANCER AND CONTROL METHOD THEREOF

BACKGROUND

1. Field

Embodiments of the present invention relate to a washing machine with a balancer to counterbalance unbalanced load produced during rotation of a drum and a control method thereof.

2. Description of the Related Art

A washing machine (commonly referring to a drum washing machine) generally includes a tub to retain water (wash water or rinse water), a drum rotatably installed in the tub to accommodate laundry, and a motor to generate driving power to rotate the drum. The washing machine performs washing operation through tumbling of the laundry along the inner wall of the cylindrical drum when the drum rotates.

The washing machine implements a series of operations through a washing cycle of separating contaminants from the laundry with detergent-dissolved water, a rinsing cycle of removing bubbles or residual detergent from the laundry with water that does not contain detergent, and a spin-drying cycle of separating water from the laundry by rotating the drum at high speed.

In the case that the laundry is not evenly distributed in the drum but is concentrated at a certain portion of the drum during high-speed rotation of the drum in the spin-drying cycle, the drum may eccentrically rotate, generating vibration and noise. In the worse case scenario, components such as the drum and motor may be damaged.

The above concern may be addressed by providing a washing machine with a balancer that counterbalances the unbalanced load in the drum to stabilize rotation of the drum.

SUMMARY

Therefore, it is an aspect of the present invention to provide a washing machine with a balancer to counterbalance unbalanced load produced during rotation of the drum to efficiently maintain balance of the drum and a control method thereof.

Additional aspects of the invention will be set forth in part in the description which follows and, in part, will be obvious from the description, or may be learned by practice of the invention.

In accordance with one aspect of the present invention, a method of controlling a washing machine including a drum, a motor to rotate the drum, and a balancer to counterbalance unbalanced load produced in the drum during rotation of the drum, including operations of (a) rotating the drum in one direction for a first time in a spin-drying cycle, (b) stopping the drum for a second time after rotating the drum in the one direction, (c) rotating the drum in a reverse direction for a third time when the second time elapses, (d) stopping the drum for a second time after rotating the drum in the reverse direction, wherein a clockwise and counterclockwise stirring operation of the drum including the operations (a) to (d) is performed at least once to perform a ball distributing cycle of evenly distributing masses in the balancer in a balancer housing.

The ball distributing cycle may be performed when the spin-drying cycle starts.

The ball distributing cycle may be performed after a drainage operation of draining water from a water tub to dry laundry.

The ball distributing cycle may be performed before a weight detection operation of detecting weight of laundry to perform spin-drying of the laundry.

In the rotating of the drum in the one direction, the motor may be maintained at certain revolutions per minute (rpm) while being driven in a normal direction for the first time.

In the rotating of the drum in the reverse direction, the motor may be maintained at the certain rpm while being driven in the reverse direction for the third time.

The first time may be equal to the third time.

The first time may be set to be longer than the third time.

The second time may be set to be shorter than the third time.

The first time may be within about 15 seconds.

The second time may be longer than or equal to 5 seconds.

In the clockwise and counterclockwise stirring operation of the drum, the certain rpm may be greater than or equal to 6 rpm.

The clockwise and counterclockwise stirring operation of the drum includes changing the certain rpm of the motor.

The clockwise and counterclockwise stirring operation of the drum may include changing a time for driving of the motor or a time for stopping of the motor.

The method may further include counting the number of times the clockwise and counterclockwise stirring operation of the drum is performed, comparing the counted number of times with a predetermined reference number of times of stirring, and stopping the clockwise and counterclockwise stirring operation of the drum when the number of times the clockwise and counterclockwise stirring operation is performed is greater than or equal to the reference number.

16. The reference number may be greater than or equal to 1.

In accordance with another aspect of the present invention, a washing machine includes a drum to accommodate laundry, a motor to rotate the drum, a balancer to counterbalance unbalanced load produced in the drum during rotation of the drum, and a controller to control, when a spin-drying cycle starts, the motor to stir the drum clockwise and counterclockwise and to count the number of times of clockwise and counterclockwise stirring and perform a ball distributing cycle of stopping clockwise and counterclockwise stirring of the drum when the counted number of times reaches a predetermined reference number of times of stirring, wherein the balancer includes a balancer housing mounted to the drum and provided with an annular formed therein, a least one mass movably disposed in the channel, and a magnet mounted to the balancer housing to restrict the mass.

In the clockwise and counterclockwise stirring of the drum, the controller may drive the motor at certain revolutions per minute (rpm) for a certain time.

The controller may cause the drum to perform stirring rotation at low speed with the rpm of the motor being greater than or equal to 6 rpm.

The washing machine according to claim 19, wherein the controller drives the motor for 15 seconds or more with the rpm of the motor being greater than or equal to 6 rpm.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
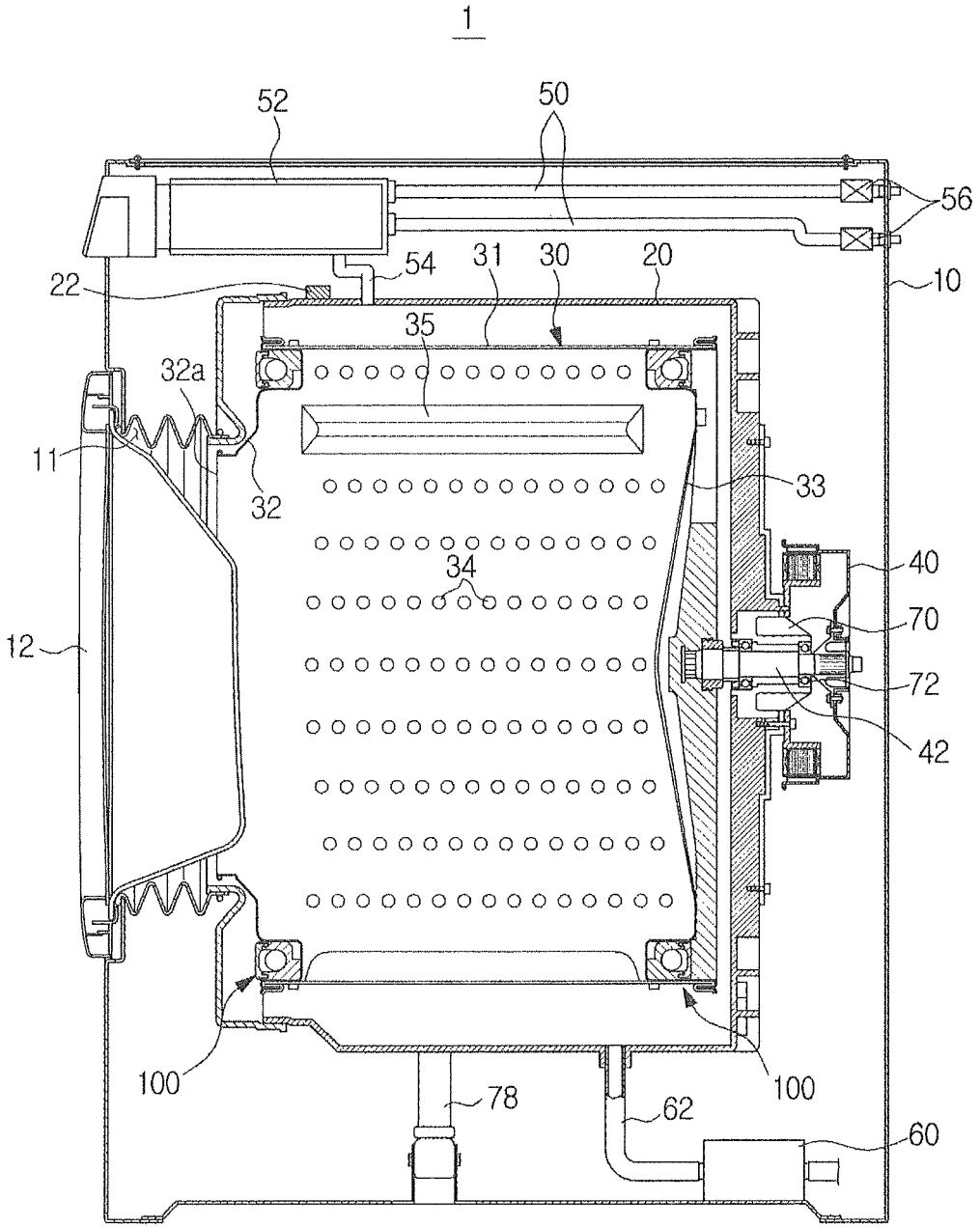
FIG. 1 is a view illustrating the configuration of a washing machine according to an exemplary embodiment of the present invention.

Reference will now be made in detail to the embodiments of the present invention, examples of which are illustrated in the accompanying drawings, wherein like reference numerals refer to like elements throughout.

FIG. 1 is a view illustrating the configuration of a washing machine according to an exemplary embodiment of the present invention.

In FIG. 1, a washing machine 1 includes a cabinet 10 forming an external appearance of the washing machine 1, a tub 20 disposed in the cabinet 10, a drum 30 rotatably disposed in the tub 20, and a motor 40 to drive the drum 30.

The front of the cabinet 10 is provided with an introduction port 11 allowing laundry to be introduced into the drum 30 therethrough. The introduction port 11 is opened and closed by a door 12 installed at the front of the cabinet 10.

A vibration sensor 22 to measure vibration of the tub 20 produced during rotation of the drum 30 is securely attached to the exterior of the upper portion of the tub 20. The vibration sensor 22 may employ a microelectromechanical system (MEMS) sensor to measure displacement of the tub 20 moving according to vibration of the tub 20, a 3-axis acceleration sensor to measure vibration of the tub 20 in the three axial directions (the X-axis direction, Y-axis direction, and Z-axis direction), and a gyro sensor, which is an angular speed sensor. Herein, a displacement signal measured by the vibration sensor 22 is mainly used to determine whether to perform high-speed spin-drying in the spin-drying cycle by estimating the balance condition of the laundry in the drum 30 while the drum 30 is accelerated to reduce vibration of the tub 20.

In addition, a water supply pipe 50 allowing wash water to be supplied into the tub 20 therethrough is installed at an upper portion of the tub 20. One side of the water supply pipe 50 is connected to a water supply valve 56, and the other side of the water supply pipe 50 is connected to a detergent feed unit 52.

The detergent feed unit 52 is connected to the tub 20 via a connection pipe 54. The water supplied through the water supply pipe 50 is supplied into the tub 20 via the detergent feed unit 52. At this time, detergent is also supplied into the tub 20.

A drainage pump 60 and a drainage pipe 62 are installed at a lower portion of the tub 20 to discharge the water in the tub 20 from the cabinet 10.

The drum 30 includes a cylindrical portion 31, a front plate 32 disposed at the front of the cylindrical portion 31, and a rear plate 33 disposed at the back of the cylindrical portion 31. An opening 32*a* allowing introduction and retrieval of laundry therethrough is formed in the front plate 32 and a drive shaft 42 to transmit power of the motor 40 is connected to the rear plate 33.

Multiple through holes 34 allowing flow of wash water therethrough are formed in the circumference of the drum 30, and a plurality of lifters 35 is installed on the inner circumferential surface of the drum 30 to cause the laundry to rise and fall when the drum 30 rotates.

The drive shaft 42 is disposed between the drum 30 and the motor 40. One end of the drive shaft 42 is connected to the rear plate 33 of the drum 30, and the other end of the drive shaft 42 extends outward of the rear wall of the tub 20. When the motor 40 drives the drive shaft 42, the drum 30 connected to the drive shaft 42 rotates about the drive shaft 42.

A bearing housing 70 is installed at the rear wall of the tub 20 to rotatably support the drive shaft 42. The bearing housing 70 may be formed of aluminum alloy and may be inserted into the rear wall of the tub 20 when the tub 20 is fabricated through injection molding. Bearings 72 are installed between the bearing housing 70 and the drive shaft 42 to allow smooth rotation of the drive shaft 42.

The tub 20 is supported by a damper 78. The damper 78 connects the inner bottom surface of the cabinet 10 to the outer surface of the tub 20.

In the washing cycle, the motor 40 rotates the drum 30 at low speed in the normal direction and reverse direction. Thereby, contaminants are removed from the laundry in the drum 30 as the laundry repeatedly rises and falls.

In the spin-drying cycle, when the motor 40 rotates the drum 30 at high speed in one direction, water is separated from the laundry by the centrifugal force acting on the laundry.

In the case that the laundry is unevenly distributed or concentrated at a certain portion in the drum 30 during rotation of the drum 30 in the spin-drying cycle, rotation of the drum 30 become unstable, resulting in vibration and noise.

Accordingly, the washing machine 1 is provided with a balancer 100 to stabilize rotation of the drum 30.

Figure 2:
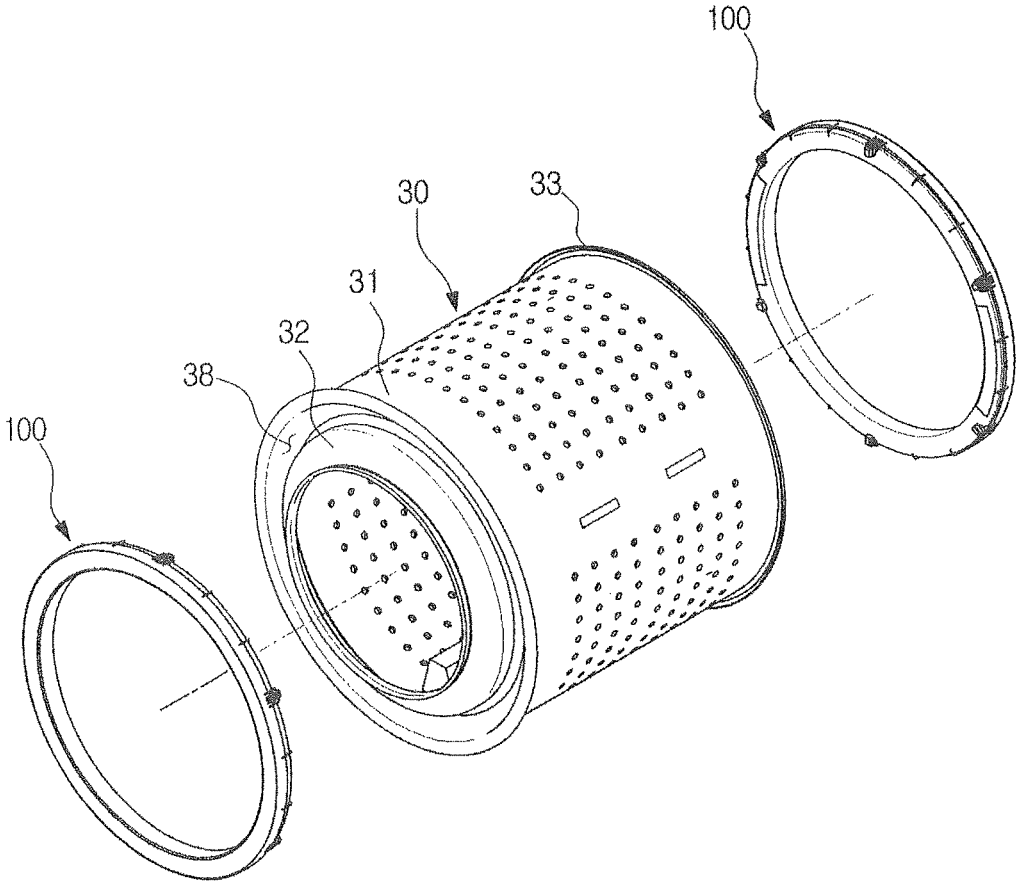
FIG. 2 is an exploded perspective view illustrating a balancer and a drum according to one embodiment of the present invention.
Figure 3:
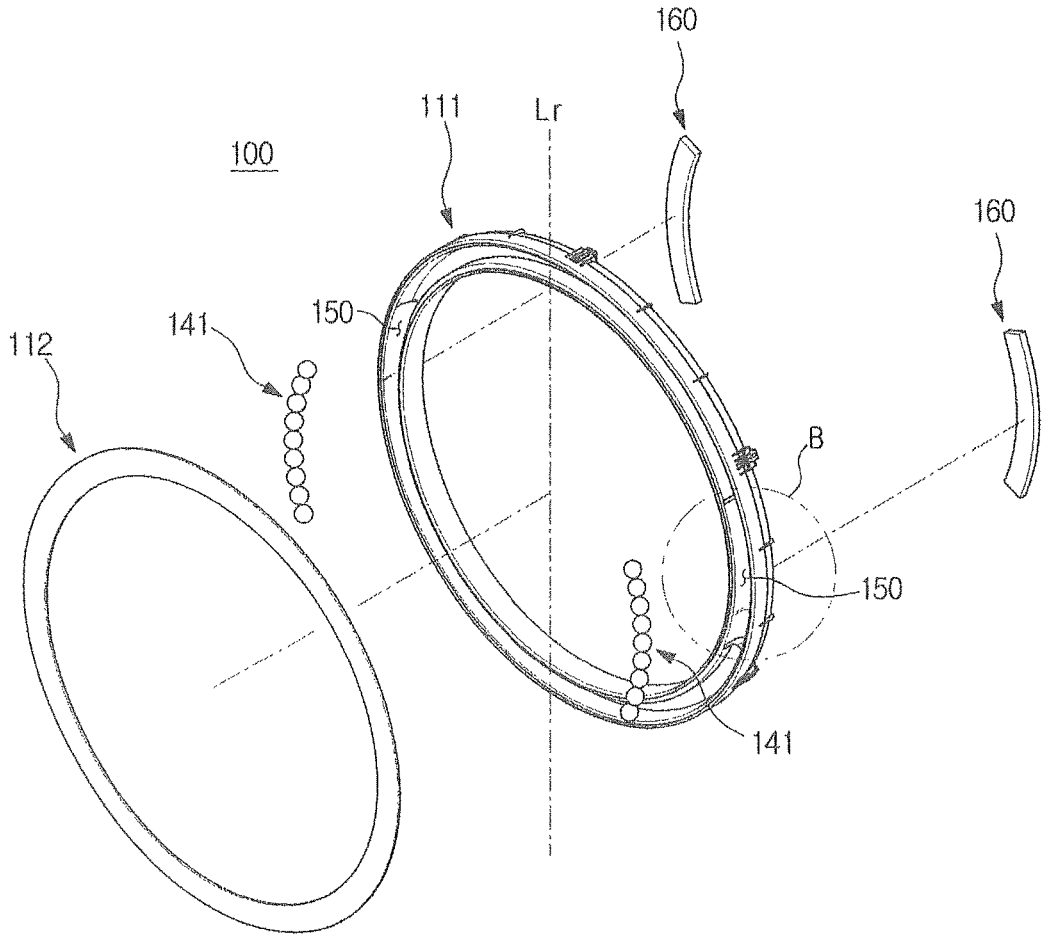
FIG. 3 is an exploded perspective view illustrating the balancer of FIG. 2.
Figure 4:
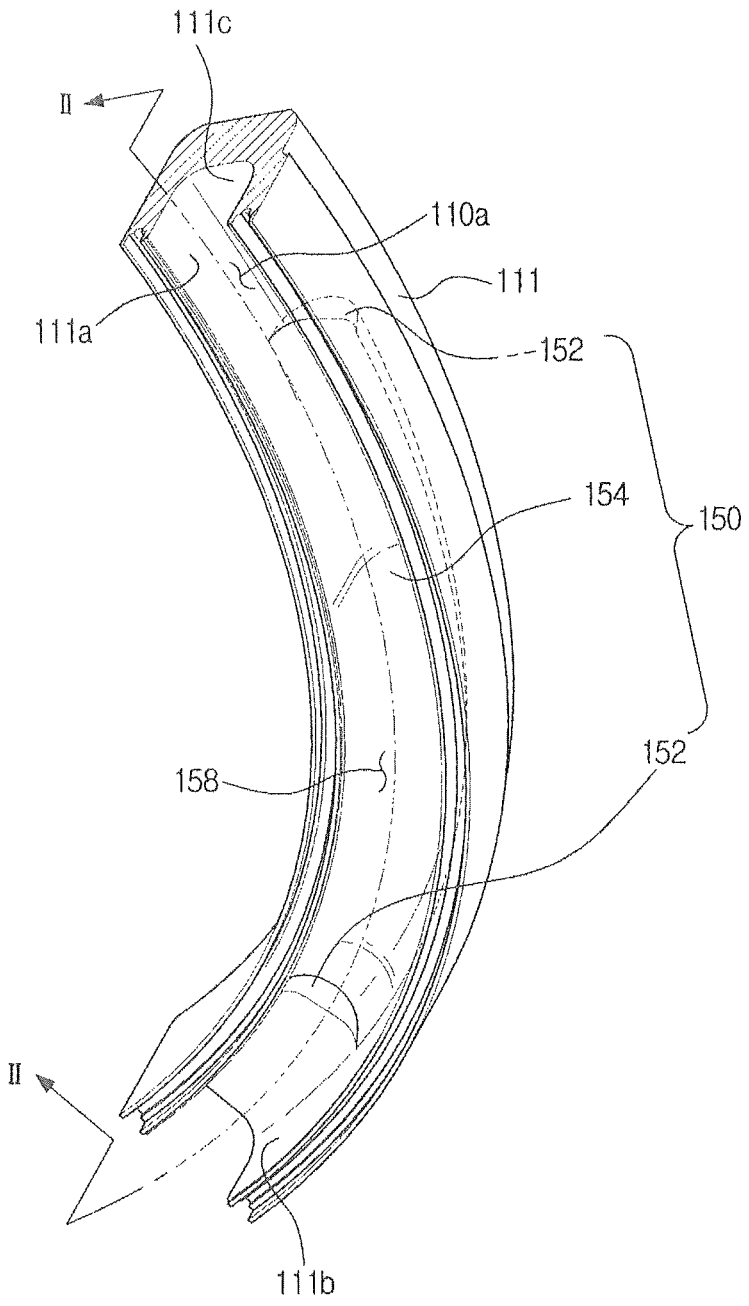
FIG. 4 is an enlarged view illustrating portion B of FIG. 3.
Figure 5:
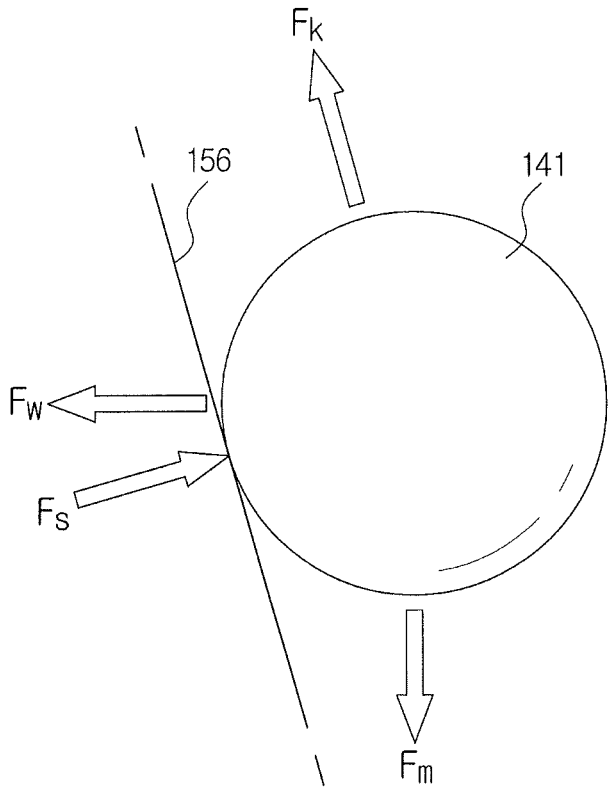
FIG. 5 is a view illustrating a relationship between centrifugal force, magnetic force, and support force by an inclined sidewall.
Figure 6:
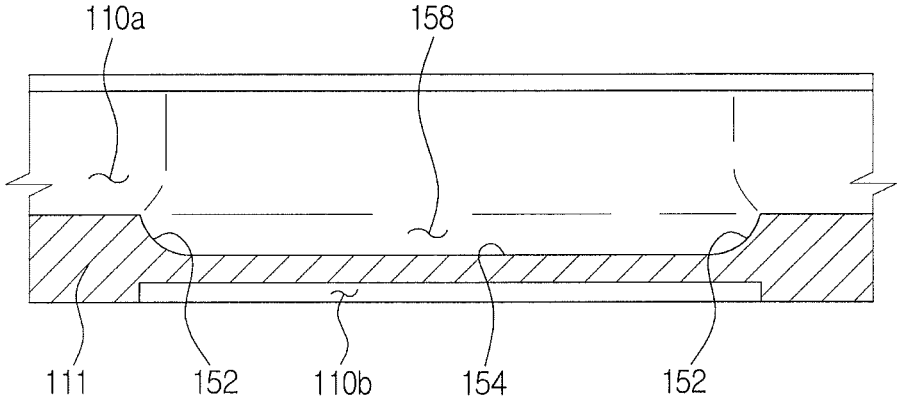
FIG. 6 is a cross-sectional view taken along line II-II of FIG. 4.
Figure 7:
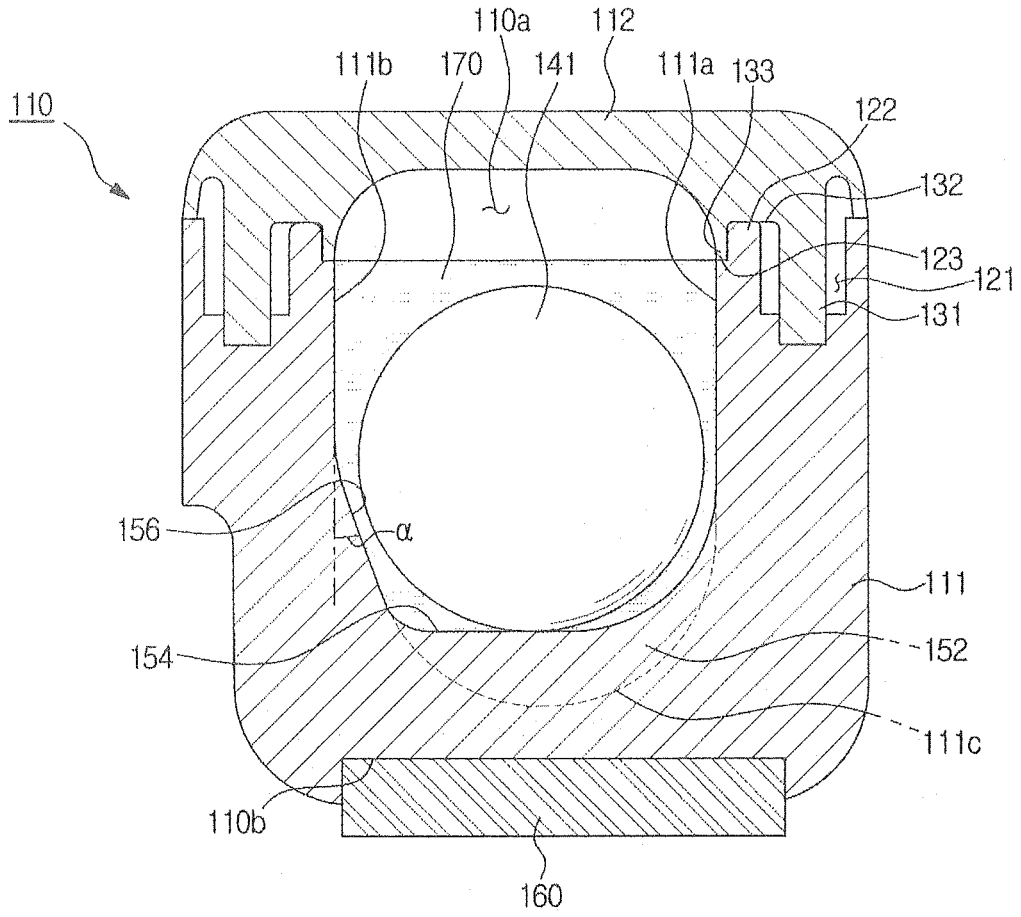
FIG. 7 is a view illustrating coupling between a balancer housing and a magnet according to one embodiment of the present invention.

FIG. 2 is an exploded perspective view illustrating a balancer and a drum according to one embodiment of the present invention, and FIG. 3 is an exploded perspective view illustrating the balancer of FIG. 2, and FIG. 4 is an enlarged view illustrating portion B of FIG. 3. FIG. 5 is a view illustrating a relationship between centrifugal force, magnetic force, and support force by an inclined sidewall, FIG. 6 is a cross-sectional view taken along line of FIG. 4, and FIG. 7 is a view illustrating coupling between a balancer housing and a magnet according to one embodiment of the present invention.

The balancer 100 may be mounted to at least one of the front plate 32 and rear plate 33 of the drum 30. Hereinafter, a description will be given of the balancer 100 mounted to the front plate 32, which is identical to the balancer 100 mounted to the rear plate 33.

In FIGS. 2 to 7, the balancer 100 includes a balancer housing 110 having an annular channel 110*a*, and a plurality of the masses 141 disposed in the annular channel 110*a* to balance the drum 30 by moving along the annular channel 110*a*.

The front plate 32 of the drum 30 is provided with an annular recess 38 whose front is open. The balancer housing 110 is accommodated in the recess 38. The balancer housing 110 may be securely fixed to the drum 30.

The balancer housing 110 includes a first housing 111 which has an annular shape and is open at one side, and a second housing 112 to cover the open portion of the first housing 111. The inner surface of the first housing 111 and the inner surface of the second housing 112 define the annular channel 110*a*. The first housing 111 and the second housing 112 may be fabricated through injection molding of plastics such as polypropylene (PP) and acrylonitrile butadiene styrene (ABS) resin and joined to each other by thermal fusion. Hereinafter, one surface of the balancer housing 110 exposed forward by coupling of the balancer housing 110 to the drum 30 is defined as the front surface of the balancer housing 110, and another surface of the balancer housing 110 which is opposite to the front surface of the balancer housing 110 and caused to face the front plate 32 of the drum 30 by coupling of the balancer housing 110 to the drum 30 is defined as the rear surface of the balancer housing 110. The other surface of the balancer housing 110 connecting the front surface and rear surface of the balancer housing 110 is defined as the lateral surface of the balancer housing 110.

A first coupling groove 121 is formed at both sides of the channel 110*a* in the first housing 111, and the second housing 112 is provided with a first coupling protrusion 131 coupled to the first coupling groove 121. A second coupling protrusion 122 is formed between the first coupling groove 121 and a channel 110*a* of the first housing 111. The second coupling protrusion 122 of the first housing 111 is coupled to a second coupling groove 132, which is formed inside the first coupling protrusion 131 of the second housing 112. A third coupling groove 123 is formed in the inner side surface of the second coupling protrusion 122 adjacent to the channel 110*a*, and the second housing 112 is provided with a third coupling protrusion 133 coupled to the third coupling groove 123. This coupling structure may allow the first housing 111 and the second housing 112 to be securely coupled to each other and prevent fluid leakage in the case that a fluid such as oil is contained in the channel 110*a*.

The first housing 111 includes a first inner surface 111*a*, a second inner surface 111*b*, which are disposed to face each other, and a third inner surface 111*c*. The first inner surface 111*a* and second inner surface 111*b* are disposed to face each other, and the third inner surface 111*c* connects the first inner surface 111*a* to the second inner surface 111*b*.

A groove 150 to seat and temporarily restrict a plurality of masses 141 is formed in at least one of the first inner surface 111*a*, the second inner surface 111*b*, and the third inner surface 111*c*. While the groove 150 is illustrated as being formed in both the first inner surface 111*a* and the third inner surface 111*c* in FIGS. 5 and 6, embodiments of the present invention are not limited thereto. The groove 150 may be formed in only one of the first inner surface 111*a*, the second inner surface 111*b*, and the third inner surface 111*c*, or formed in both the first inner surface 111*a* and the third inner surface 111*c*, or formed in the first inner surface 111*a*, the second inner surface 111*b*, and the third inner surface 111*c*.

The groove 150 include first supporters 152 extending in a circumferential direction of the balancer housing 110 to accommodate at least two masses 141 and adapted to support the masses 141 approximately in the circumferential direction and radial direction of the balancer housing 110, and a second supporter 154 provided between the first supporters 152 to support the masses 141 approximately in the radial direction of the balancer housing 110. The first supporters 152 are formed in the shape of a step at both ends of the groove 150 to prevent the masses 141 from escaping from the groove 150 when the rotational speed of the drum 30 is within a certain range of rotational speed.

In addition, to prevent the masses 141 seated in the groove 150 from producing unbalanced load in the drum 30, the groove 150 may be symmetrically disposed with respect to an imaginary line Lr passing through the center of rotation of the drum 30 and perpendicular to the ground.

The second inner surface 111*b* corresponding to the first inner surface 111*a* with the groove 150 is provided with an inclined sidewall 156. As shown in FIG. 5, the inclined sidewall 156 generates supporting force Fs to support the masses 141 in the direction in which the inclined sidewall 156 resists the centrifugal force Fw applied to the masses 141 when the drum 30 rotates. Accordingly, when the drum 30 rotates, the centrifugal force Fw applied to the masses 141 is counterbalanced by the supporting force Fs applied to the masses 141 by the inclined sidewall 156. Therefore, as will be described later, the magnetic force Fm produced by magnets 160 joined to the rear surface of the balancer housing 110 may only counterbalance the force Fk created on the masses 141 along the inclined sidewall 156 such that movement of the masses 141 is restricted when the rotational speed of the drum 30 is within a specific range of rotational speed. By forming the inclined sidewall 156 on the second inner surface 111*b* corresponding to the first inner surface 111*a* having the groove 150 such that the centrifugal force Fw applied to the masses 141 during rotation of the drum 30 is counterbalanced by the inclined sidewall 156, movement of the masses 141 may be effectively restricted with a low strength of magnetic force Fm.

The inclination angle $\alpha$ of the inclined sidewall 156 may be between about 5 degrees and about 25 degrees and vary in the circumferential direction of the second inner surface 111*b*. That is, the inclination angle $\alpha$ of the inclined sidewall 156 may be maintained to be 5 degrees in one section of the inclined sidewall 156 and to be an angle greater than or less than 5 degrees in another section of the inclined sidewall 156. In addition, the inclination angle $\alpha$ of the inclined sidewall 156 may consistently increase or decrease in the circumferential direction of the second inner surface 111*b*. By changing the inclination angle $\alpha$ of the inclined sidewall 156 along the circumference of the inner surface of the balancer housing 110, the masses 141 accommodated in the groove 150 are prevented from becoming stuck in the groove 150.

The channel 110*a* includes a cross section increasing portion 158 formed by increasing the cross section of the channel 110*a* at the position where the groove 150 is formed. The cross section increasing portion 158, which is formed in the channel 110*a* by the groove 150, may have a shape corresponding to at least one portion of the masses 141 and extend in the circumferential direction of the balancer housing 110 to accommodate at least two masses 141, which is similar to the groove 150. In addition, the cross section increasing portion 158 may be symmetrically disposed with respect to the imaginary line Lr passing through the center of rotation of the drum 30.

Each of the masses 141 is spherically formed of metal and movably disposed along the annular channel 110*a* in the circumferential direction of the drum 30 in order to counterbalance unbalanced load present in the drum 30 during rotation of the drum 30. When the drum 30 rotates, centrifugal force is applied to the masses 141 in a direction in which the radius of the drum 30 increases. The masses 141 escaping from the groove 150 balance the drum 30 by moving along the channel 110*a*.

The masses 141 may be accommodated in the first housing 111 before the first housing 111 and the second housing 112 are attached to each other by fusion.

The masses 141 accommodated in the first housing 111 may be disposed in the balancer housing 110 through fusion attachment between the first housing 111 and the second housing 112.

A damping fluid 170 is accommodated in the balancer housing 110 to prevent sudden movement of the masses 141.

When force is applied to the masses 141, the damping fluid 170 resists movement of the masses 141, thereby preventing the masses 141 from abruptly moving in the channel 110*a*. The damping fluid 170 may be an oil. The damping fluid 170 partially functions to balance the drum 30 in conjunction with the masses 141 when the drum 30 rotates.

The damping fluid 170 is introduced into the first housing 111 when the masses 141 are introduced. Thereafter, the damping fluid 170 is accommodated in the balancer housing 110 through fusion attachment between the first housing 111 and the second housing 112. However, accommodating the damping fluid 170 in the balancer housing 110 is not limited to the above method. The damping fluid 170 may be accommodated in the balancer housing 110 by attaching the first housing 111 and the second housing 112 to each other by fusion and then injecting the damping fluid 170 into the balancer housing 110 through an introduction portion (not shown) formed in the first housing 111 or the second housing 112.

At least one magnet 160 to restrict the masses 141 in conjunction with the groove 150 is coupled to the rear surface of the balancer housing 110. At least one surface of the magnet 160 may face one side of the drum 30. For example, at least one surface of the magnet 160 may face one side of the front plate 32 of the drum 30.

In addition, the rear surface of the balancer housing 110 corresponding to the inner surface of the balancer housing 110 having the groove 150 is provided with a magnet accommodation hole 110*b* allowing the magnet 160 to be accommodated therein and coupled thereto. The magnet accommodation hole 110*b* may be formed in a shape corresponding to the magnet 160 to allow the magnet 160 to be coupled thereto.

The magnet 160 is formed approximately in a rectangular shape and coupled to the rear surface of the balancer housing 110 to restrict the at least one mass 141 accommodated in the groove 150 such that the mass 141 does not escape from the groove 150. The magnet 160 may be fixed by being fitted into the magnet accommodation hole 110*b* or by a separate bonding material.

The position at which the magnet 160 is coupled is not limited to the rear surface of the balancer housing 110. The magnet 160 may be coupled to the front surface of the balancer housing 110 or the lateral surface of the balancer housing 110 connecting the front surface and rear surface of the balancer housing 110.

The magnet 160 restricts the mass 141 through magnetic force, and the strength of the magnetic force of the magnet 160 is determined based on the rotations per minute of the drum 30 at the time when the mass 141 escapes from the groove 150, i.e., based on rotational speed. For example, to ensure that the rotational speed of the drum 30 at the moment of escape of the mass 141 from the groove 150 is 200 rpm, the strength of the magnetic force of the magnet 160 may be adjusted to restrict the at least one mass 141 accommodated in the groove 150 such that the mass 141 does not escape if the rotational speed of the drum 30 is between 0 rpm and 200 rpm and to allow the mass 141 to escape from the groove 150 if the rotational speed of the drum 30 exceeds 200 rpm. Herein, if the rotational speed of the drum 30 is between 0 rpm and 200 rpm, the strength of the magnetic force of the magnets 160 is greater than that of the centrifugal force applied to the mass 141. If the rotational speed of the drum 30 exceeds 200 rpm, the strength of the magnetic force is less than that of the centrifugal force applied to the mass 141. If the rotational speed of the drum 30 is 200 rpm, the strength of the magnetic force is equal to that of the centrifugal force applied to the masses 141.

The strength of the magnetic force of the magnets 160 may be adjusted as desired according to the size, number and magnetization method of the magnets 160.

Figure 8:
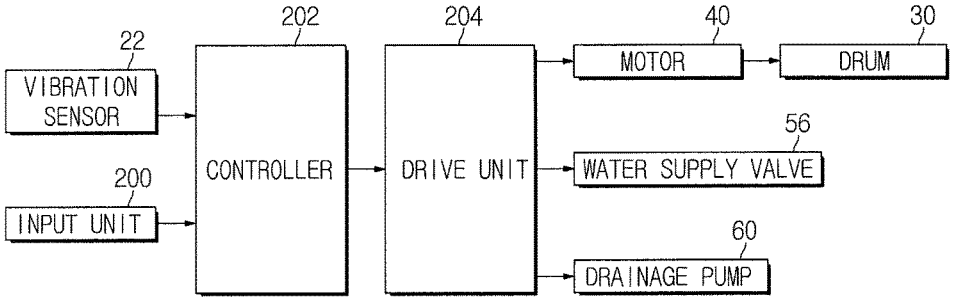
FIG. 8 is a control block diagram illustrating a washing machine according to one embodiment.

FIG. 8 is a control block diagram illustrating a washing machine according to one embodiment.

Referring to FIG. 8, the washing machine 1 further includes an input unit 200, a controller 202 and a drive unit 204.

The input unit 200 is manipulated by a user to input a command to execute a washing cycle, a rinsing cycle and a spin-drying cycle of the washing machine. The input unit 200 may be provided with a key, a button, a switch, and a touch pad. The input unit 200 includes all devices that produce input data upon manipulation such as pushing, contacting, pressing, and turning.

In addition, the input unit 200 includes multiple buttons (for power, reservation, wash water temperature, soaking, washing, rinsing, spin-drying, and type of detergent) through which the user inputs commands related to operations of the washing machine 1. The buttons include a washing course section button to select one of washing courses based on the type of laundry introduced into the washing machine 1 (the washing courses include a standard course, wool course, and a fine course, and the user may select, for example, the standard washing according to the type of laundry).

The controller 202 is a microcomputer that controls overall operations of the washing machine 1 including washing, rinsing and spin-drying according to operation information input through the input unit 200. In a selected washing course, a target water level for washing, target water level for rinsing, target RPM, and operation factor (On-Off time of the motor), and time for washing and rinsing are set according to the weight of laundry (amount of load).

In addition, during the spin-drying cycle, the controller 202 implements the ball distributing cycle by seating the masses 141 in the groove 150 to restrict the masses 141 in the balancer 100 with the magnets 160.

The ball distributing cycle is implemented to seat the masses 141 in the balancer 100 in the groove 150 to allow the balancer 100 to effectively maintain the balance of the drum 30 when the spin-drying cycle begins.

The ball distributing cycle includes a first ball distribution operation and a second ball distribution operation. In the first ball distribution operation, the drum 30 is rotated at low speed in one direction to seat the masses 141 in the groove 150 in order to cause the masses 141 to be restricted by the magnets 160 in an interval below a certain interval in which transient vibration of the drum 30 occurs. In the second distribution operation, the drum 30 is rotated in a direction of rotation opposite to the direction of rotation in the first distribution operation to seat some of the masses 141 not yet seated in the groove 150.

In the ball distributing cycle, the drum 30 is rotated at a rotational speed (greater than or equal to about 6 rpm) that causes the masses 141 in the balancer 100 to move in the direction opposite to rotation of the drum 30, for a time (about 15 seconds or less) that allows the masses 141 in the balancer 100 to be seated in the groove 150.

In addition, the number of times that stirring is performed by the motor for the ball distributing cycle may be determined based on the size (volume) of the drum 30 or the number of the masses 141. Normal and reverse rotation of the drum 30 to rotate in two directions is performed at least once.

To this end, the controller 202 is adapted to count the number of times of motor stirring in the ball distributing cycle and terminate the ball distributing cycle when the counted number of times of stirring reaches a predetermined reference number of times of stirring.

The drive unit 204 drives the motor 40, the water supply valve 56 and the drainage pump 60, which are related to operations of the washing machine 1, according to a driving control signal from the controller 202.

Hereinafter, a method of controlling a washing machine with a balancer according to one embodiment of the present invention and an operational effect thereof will be described.

Figure 9A:
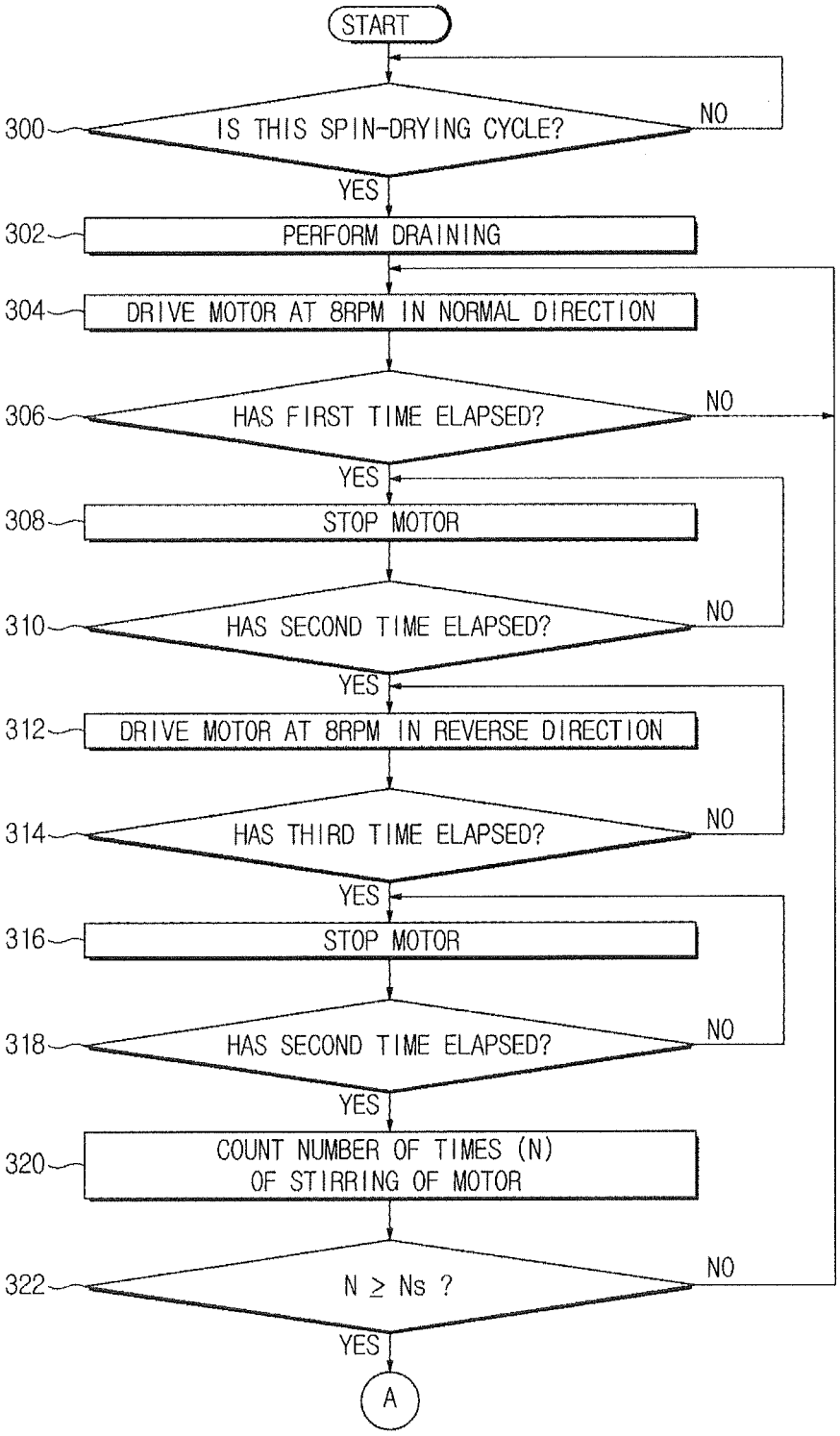
FIGS. 9A and 9B are flowcharts illustrating a method of controlling a washing machine with a balancer according to one embodiment of the present invention.
Figure 9B:
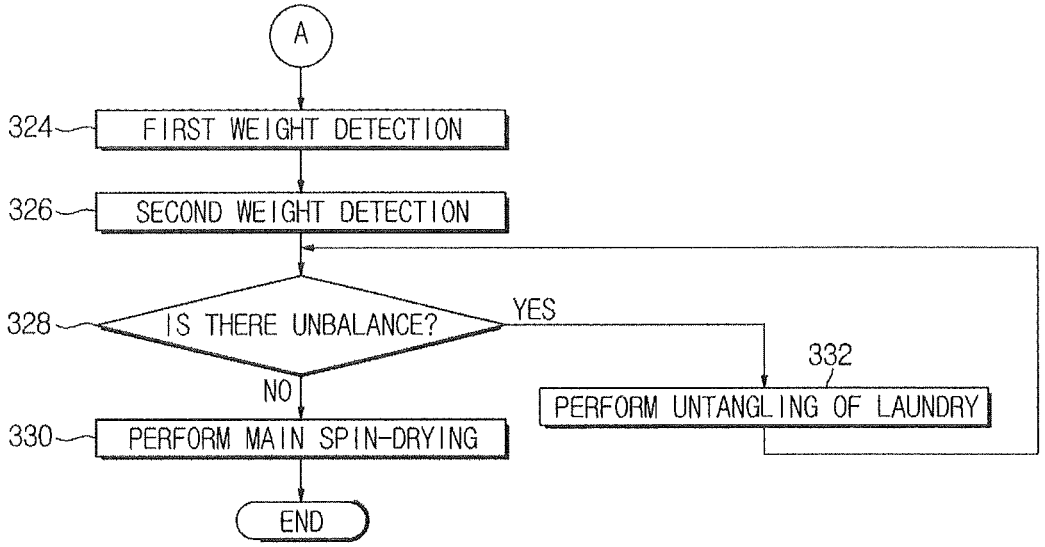
Figure 10:
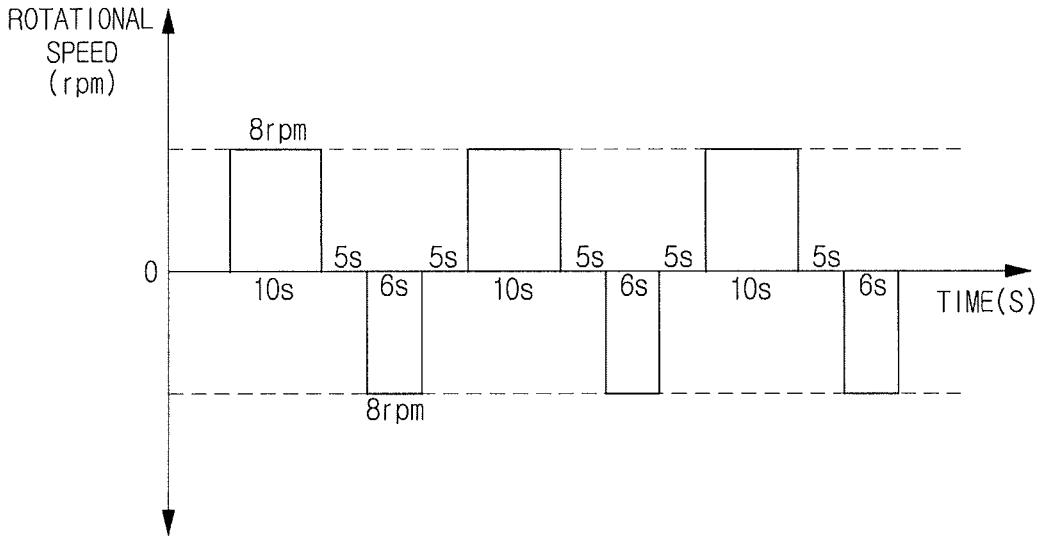
FIG. 10 is a graph depicting a profile of driving of a motor in a ball distributing cycle of a washing machine according to one embodiment of the present invention.
Figure 11:
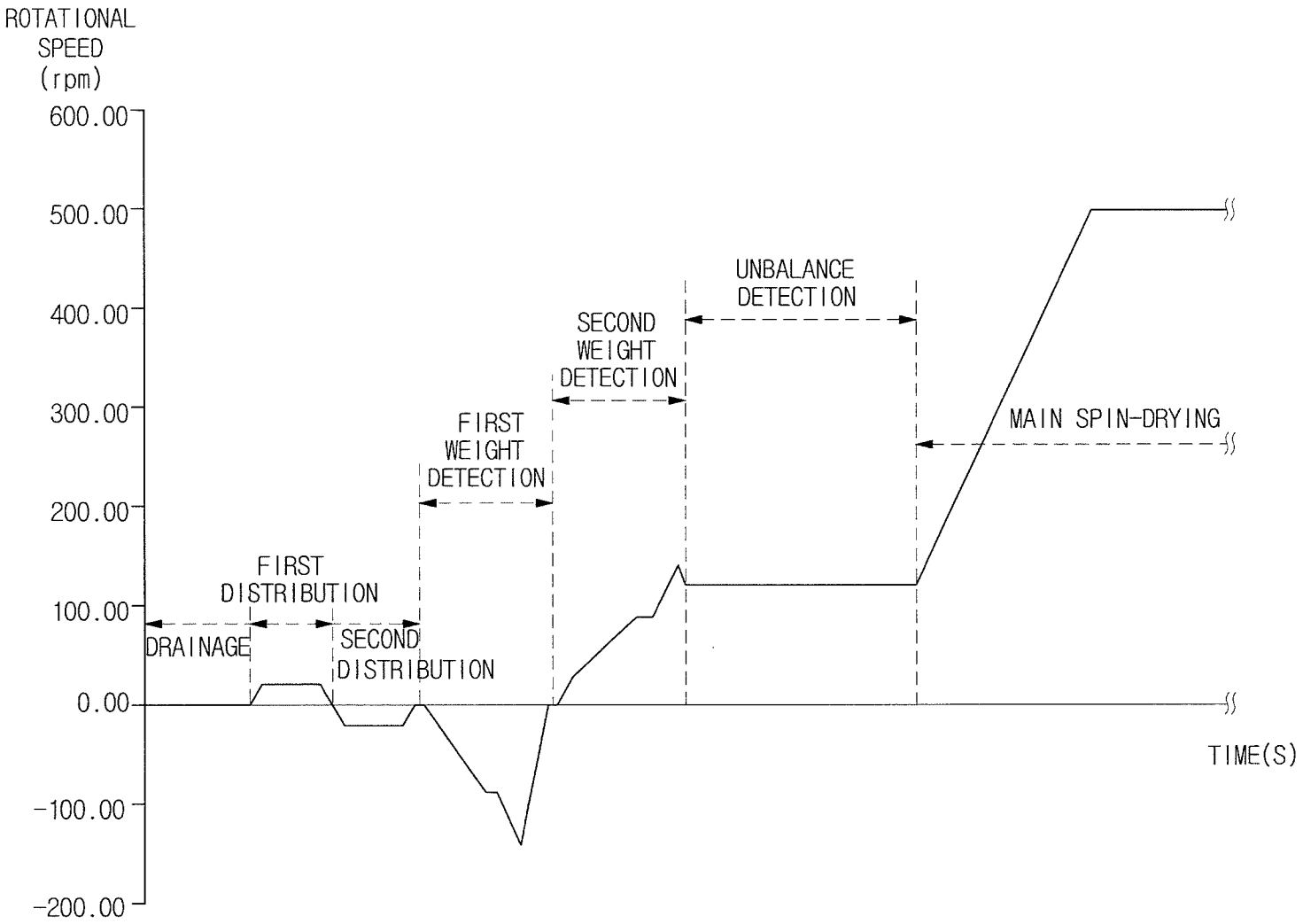
FIG. 11 is a graph depicting a profile of spin-drying in a washing machine according to one embodiment of the present invention.

FIGS. 9A and 9B are flowcharts illustrating a method of controlling a washing machine with a balancer according to one embodiment of the present invention. FIG. 10 is a graph depicting a profile of driving of a motor in the ball distributing cycle of a washing machine according to one embodiment of the present invention, and FIG. 11 is a graph depicting a profile of spin-drying in a washing machine according to one embodiment of the present invention.

Referring to FIGS. 9A and 9B, the user places laundry in the drum 30 and manipulates buttons in the input unit 200 to select operation information such as a washing course and addition of rinsing according to the type of the laundry. Then, the selected information is input to the controller 202 through the input unit 200.

Thereby, the controller 202 implements a series of operations to perform the washing cycle, rinsing cycle, and spin-drying cycle according to the operation information input through the input unit 200.

To control spin-drying in one embodiment of the present invention, the controller 202 determines whether the current cycle is the spin-drying cycle (300), if so, the controller 202 operates the drainage pump 60 through the drive unit 204 to drain the water from the tub 20 via the drainage pipe 62 (302).

When draining is completed, the controller 202 performs the ball distributing cycle of seating the masses 141 in the groove 150 at the initial stage of spin-drying in order to restrict the masses 141 in the balancer 100 to the magnets 160.

In the case that unbalanced mass is produced due to maldistribution of the laundry during rotation of the drum 30, the masses 141 in the balancer housing 110 move to a position opposite to the position of the unbalanced mass in the circumferential direction. At this time, the masses 141 positioned to correspond to the unbalanced mass suppress unbalanced vibration of the drum 30 caused by the unbalanced mass.

In the spin-drying cycle, maldistribution is likely to occur as the laundry in the drum 30 is still wet. To suppress unbalanced vibration of the drum 30 at the initial stage of spin-drying, the balancer 100 needs to quickly recover balance of the drum 30 when the spin-drying cycle begins.

However, until the rotational speed of the drum 30 becomes greater than or equal to a certain speed, the masses 141 in the balancer 100 may move and hit the inner wall of the balancer housing 110 and even each other. Accordingly, in the case that the laundry is maldistributed, unbalance of the drum 30 may become worse, causing the masses 141 to produce unbalanced vibration in conjunction with the laundry at the initial stage of spin-drying rather than to suppress the unbalanced.

Accordingly, before rotation of the drum 30 likely to produce unbalance as in the spin-drying cycle begins, the masses 141 in the balancer 100 need to be seated in the groove 150.

To this end, the controller 202 controls the drive unit 204 to drive the motor 40 at certain revolutions per minute (rpm) (about 8 rpm) in the normal direction such that the drum 30 rotates at low speed in one direction, as shown in FIG. 10 (304).

At this time, the controller 202 counts the time for which the motor 40 rotates at the certain rpm in the normal direction, and determines whether a predetermined first time (a time allowing the masses in the balancer to be seated in the groove, about 10 seconds) has elapsed (306).

Upon determining in operation 306 that the first time has not elapsed, the controller 202 returns to operation 304 and performs the first ball distributing cycle until the first time elapses, as shown in FIG. 11.

When the drum 30 is rotated at low speed in one direction as above, the masses 141 in the balancer 100 move along the channel 110*a* of the balancer housing 110. While moving along the channel 110*a* of the balancer housing 110, the masses 141 are accommodated and seated in the groove 150. Once the masses 141 are accommodated and seated in the groove 150, movement thereof is restricted by the magnetic force of the magnets 160 while the drum 30 is maintained at a certain rotational speed.

Upon determining in operation 306 that the first time has elapsed, the controller 202 stops the motor 40 through the drive unit 204 (308), and counts the time after the motor 40 is stopped. The controller 202 then determines whether a predetermined second time (about 5 seconds) has elapsed (310).

Upon determining in operation 310 that the second time has not elapsed, the controller 202 returns to operation 308 and performs subsequent operations.

Upon determining in operation 310 that the second time has elapsed, the controller 202 rotates the motor 40 through the drive unit 204 at certain rpm (about 8 rpm) in the reverse direction to rotate the drum 30 at low speed in the direction opposite to the direction of rotation in the first ball distributing cycle, as shown in FIG. 10 (312).

At this time, the controller 202 counts the time for which the motor 40 rotates at the certain rpm in the reverse direction, and determines whether a third time (a time allowing the masses in the balancer to be seated in the groove, about 6 seconds) has elapsed (314).

Upon determining in operation 314 that the third time has not elapsed, the controller 202 returns to operation 312 and performs a second ball distributing cycle until the third time elapses, as shown in FIG. 11.

When the drum 30 is rotated at low speed in the reverse direction as above, the remaining masses 141 not yet seated in the groove 150 move along the channel 110*a* of the balancer housing 110 and are thus accommodated and seated in the groove 150. Once the masses 141 are accommodated and seated in the groove 150, movement thereof is restricted by the magnetic force of the magnets 160 while the drum 30 is maintained at a certain rotational speed.

Upon determining in operation 314 that the third time has elapsed, the controller 202 stops the motor 40 through the drive unit 204 (316), and counts the time after the motor 40 is stopped. The controller 202 then determines whether the predetermined second time (about 5 seconds) has elapsed (318).

Upon determining in operation 318 that the second time has not elapsed, the controller 202 returns to operation 316 and performs subsequent operations.

Upon determining in operation 318 that the second time has elapsed, the controller 202 counts the number N of times that the clockwise and counterclockwise stirring is performed according to rotation of the motor 40 in the normal and reverse directions (hereinafter, the number of times of stirring (320).

Subsequently, the controller 202 determines whether the counted number of times of stirring N has reached a reference number Ns (an optimum number allowing the masses in the balancer to be seated in the groove, which is about 3) (322).

The number of times of stirring in the ball distributing cycle may be determined based on the size (volume) of the drum 30 or the number of the masses 141, rotation of the drum 30 rotating bidirectionally in the normal and reverse directions is performed at least once.

Upon determining in operation 322 that the number of times of motor stirring N has not reached the reference number of times of stirring Ns, the controller 202 returns to operation 304 and drives the motor 40 in the normal and reverse directions to keep performing the ball distributing cycle of clockwise and counterclockwise stirring of the drum 30 until the reference number of times of stirring Ns is reached.

Upon determining in operation 322 that the number of times of motor stirring N has reached the reference number of stirrings Ns, the masses 141 in the balancer 100 are evenly distributed in the balancer housing 110, and thus the controller 202 terminates the ball distributing cycle.

Thereafter, the controller 202 detects the weight (load) of the laundry in the drum 30 to perform the spin-drying cycle (324, 326). The weight of the laundry is detected by the controller 202 by instantly accelerating the motor 40 to certain rpm (about 100 rpm) through the drive unit 204 in the normal and reverse directions and using the time taken for the motor 40 to be instantly accelerated to the certain rotational speed (or a certain revolutions per minute), as shown in FIG. 11.

Alternatively, the weight of the laundry may be detected by applying torque to the motor 40 for a certain time, directly or indirectly measuring inertia of the drum 30, and applying the second law of motion (torque=inertia×acceleration). Alternatively, the weight (load) of the laundry may be detected using a load cell.

Once the weight (load) of the laundry is detected, the controller 202 detects unbalance of the laundry. The unbalance of the laundry is detected by estimating the degree of unbalance in the drum 30 at a predetermined rotational speed of the drum 30 (an unbalance measuring speed, which is about 140 rpm) utilizing information about the weight of the laundry and a control variable such as speed ripple or current ripple.

Accordingly, the controller 202 determines whether unbalance of the laundry has been detected (328). In the case that unbalance is not detected, the controller 202 performs main spin-drying at predetermined rpm for spin-drying (greater than or equal to about 500 rpm) (330).

Upon determining in operation 328 that the unbalance has been detected, the controller 202 drives the motor 40 through the drive unit 204 to rotate the drum 30 clockwise and counterclockwise. Thereby, the controller 202 performs the laundry untangling operation of untangling the laundry by agitation (332), and then returns to operation 328 to perform subsequent operations.

In the illustrated embodiment, the motor is maintained at 8 rpm in the ball distributing cycle. However, embodiments of the present invention are not limited thereto. The same object and effect as the illustrated embodiment may be achieved even when the motor is maintained at rpm greater than or equal to 6 rpm in the ball distributing cycle.

In the illustrated embodiment, the motor is exemplarily described as being maintained at 8 rpm in the ball distributing cycle and driven to stir the drum 30 clockwise and counterclockwise with operation factors of 10 seconds for turning on of the motor and 5 seconds for turning off of the motor in the normal rotation, and operation factors of 6 seconds for turning on of the motor and 5 seconds for turning off of the motor in the reverse rotation, as shown in FIG. 10. However, embodiments of the present invention are not limited thereto. The same object and effect as the illustrated embodiment may be achieved even when an operation factor of time for turning on and off of the motor is changed according to the number of times of clockwise and counterclockwise stirring. This will be described with reference to FIG. 12.

Figure 12:
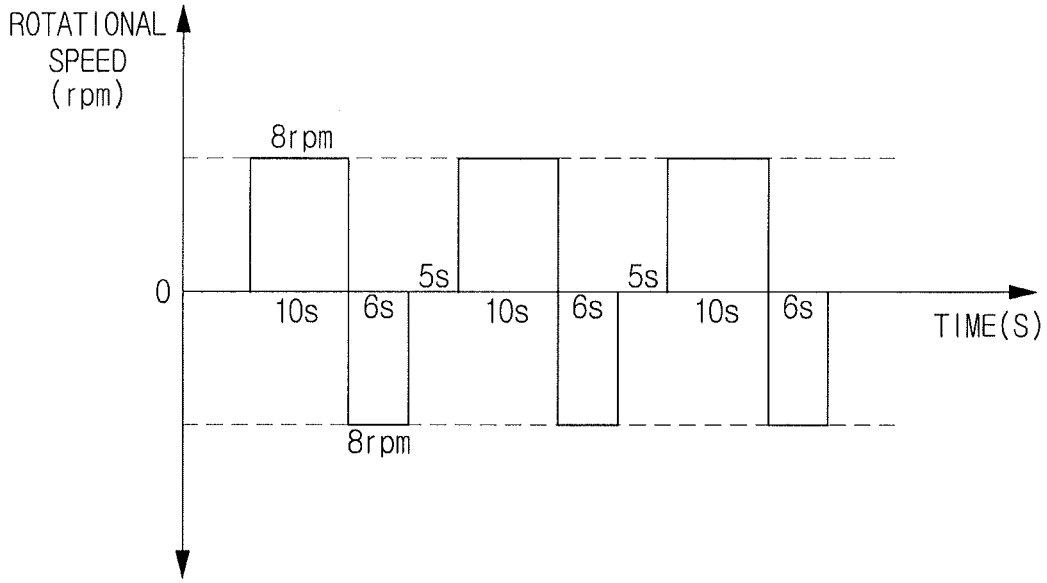
FIG. 12 is a graph depicting a profile of driving of a motor in the ball distributing cycle of a washing machine according to one embodiment of the present invention.

FIG. 12 is a graph depicting a profile of driving of a motor in the ball distributing cycle of a washing machine according to one embodiment of the present invention.

In FIG. 12, the drum 30 is stirred clockwise and counterclockwise according to the driving profile in which the motor 40 is rotated in the normal direction for the first time (about 10 seconds) and in the reverse direction for the third time (about 6 seconds) with the speed maintained at 8 rpm, and then it is stopped for the second time (about 5 seconds). Thereby, the object and effect as the illustrated above may be achieved.

Hereinafter, a description will be given of how the masses 141 are restricted by the groove 150 and the magnets 160 when the rotational speed of the drum 30 is lower than equal to a specific rotational speed and how they escape from the groove 150 to balance the drum 30 when the rotational speed of the drum 30 exceeds the specific rotational speed.

Figure 13:
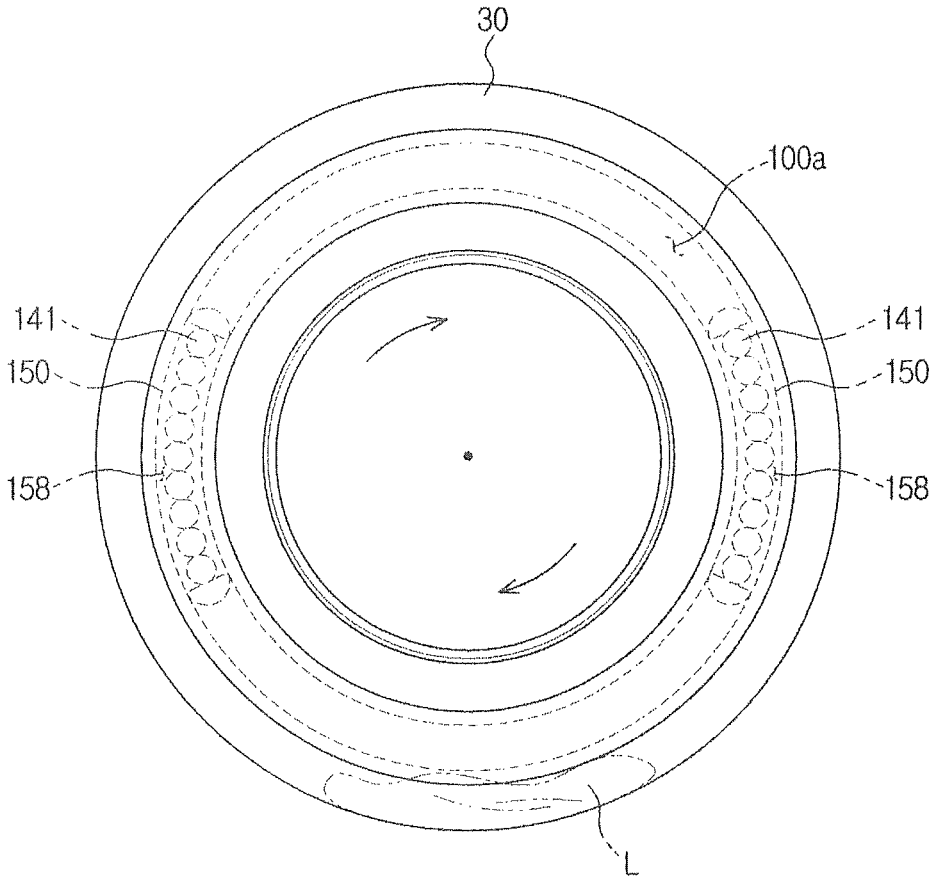
FIGS. 13 and 14 are views illustrating operation of a balancer according to one embodiment of the present invention.
Figure 14:
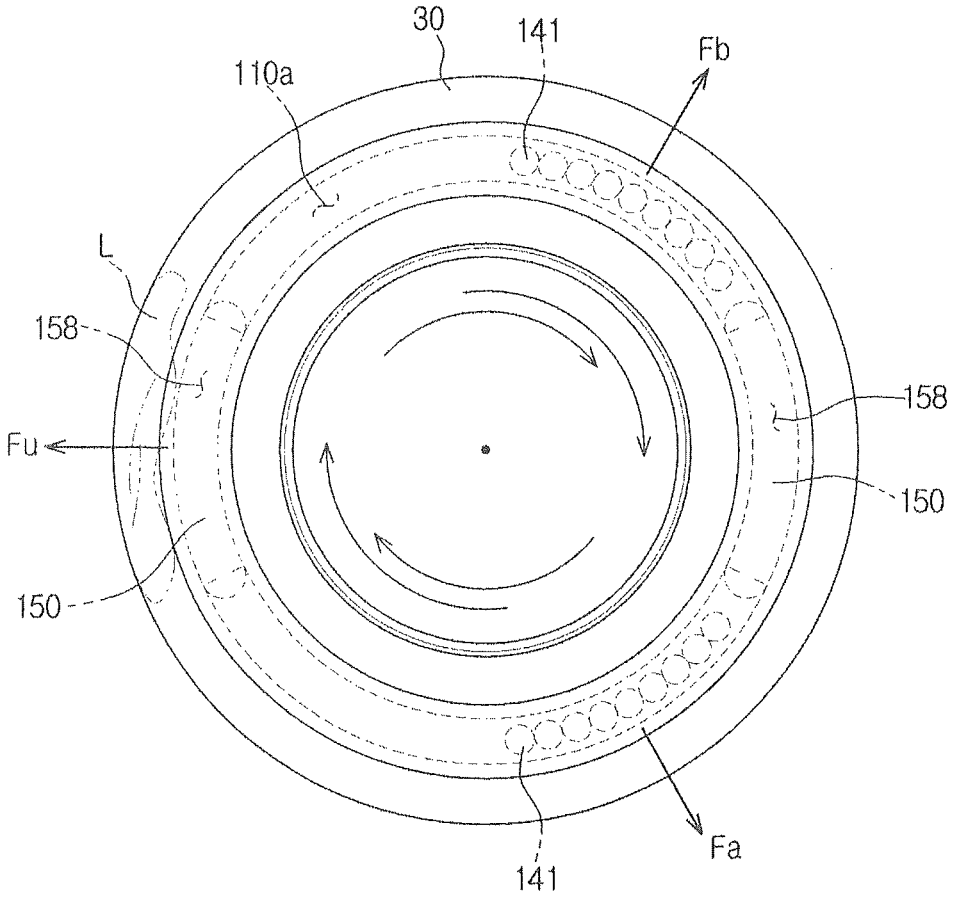

FIGS. 13 and 14 are views illustrating operation of a balancer according to one embodiment of the present invention, in which the damping fluid 170 is omitted.

Referring to FIG. 13, when the rotational speed of the drum 30 is lower than or equal to a specific rotational speed at the initial stage of spin-drying of the laundry, the masses 141 are accommodated in the groove 150 or the cross section increasing portion 158 and restricted by the magnets 160.

Before spin-drying begins, i.e., before the drum 30 rotates, all the masses 141 stay disposed at the lower portion of the balancer housing 110 by gravity. When the drum 30 begins to rotate to perform the spin-drying, centrifugal force is applied to the masses 141, causing the masses 141 to move along the channel 110*a* of the balancer housing 110. Thereby, the masses 141 are accommodated and seated in the groove 150 through movement along the channel 110*a* of the balancer housing 110. Once the masses 141 accommodated and seated in the groove 150, the movement thereof is restricted by the magnetic force of the magnets 160 until the rotational speed of the drum 30 deviates from the specific rotational speed. For example, suppose that centrifugal force applied to the masses 141, weight of the masses 141, magnetic force of the magnets 160, and the force applied by the groove 150 to support the masses 141 are designed to counterbalance each other when the rotational speed of the drum 30 is greater than or equal to 6 rpm. Then, when the rotational speed of the drum 30 is less than 6 rpm at the initial stage of spin-drying, the masses 141 remain seated in the groove 150 and movement thereof is restricted. By restricting movement of the masses 141 at the initial stage of spin-drying at which the drum 30 rotates at a relatively low speed, the masses 141 may be prevented from producing vibration of the drum 30 in conjunction with the laundry L or increasing the vibration produced by the laundry L. In addition, noise accompanying the vibration of the drum 30 may be reduced.

Referring to FIG. 14, when the rotational speed of the drum 30 is displaced from the specific rotational speed, the masses 141 escape from the groove 150 or the cross section increasing portion 158 where they have been accommodated not to move and move along the channel 110*a* of the balancer housing 110, balancing the drum 30.

For example, suppose that centrifugal force applied to the masses 141, weight of the masses 141, magnetic force of the magnets 160, and the force applied by the groove 150 to support the masses 141 are designed to counterbalance each other when the rotational speed of the drum 30 is greater than or equal to 6 rpm. Then, when the rotational speed of the drum 30 exceeds 6 rpm, the centrifugal force applied to the masses 141 increases, and therefore the masses 141 escape from the groove 150 or the cross section increasing portion 158 and moves along the channel 110*a* of the balancer housing 110. At this time, the masses 141 are controlled to slide and roll to a position for counter balancing of the unbalanced load Fu produced in the drum 30 by maldistribution of the laundry L, i.e., a position opposite to the position at which the unbalanced load Fu is applied. Thereby, force Fa and Fb to counterbalance the unbalanced load Fu is produced to stabilize rotation of the drum 30.

As is apparent from the above description, a washing machine according to an embodiment of the present invention has a balancer to counterbalance unbalanced load produced during rotation of the drum. The washing machine and a control method thereof seat a mass in a groove in the balancer before rotation of the drum possibly producing unbalance as in the spin-drying cycle begins, thereby efficiently maintaining balance of the drum. Accordingly, vibration in the drum may be reduced and product liability incident due to touch of the frame may be prevented.

Although a few embodiments of the present invention have been shown and described, it would be appreciated by those skilled in the art that changes may be made to the embodiments without departing from the principles and spirit of the invention, the scope of which is defined in the claims and their equivalents.

What is claimed is:

1. A method of controlling a washing machine including a drum, a motor to rotate the drum, and a balancer including a plurality of masses, a groove including an inclined sidewall to accommodate the plurality of masses, and at least one magnet coupled to a surface of a balancer housing to counterbalance unbalanced load produced in the drum during rotation of the drum, the method comprising operations of:

(a) rotating the drum in one direction for a first length of time in a spin-drying cycle;

(b) stopping the drum for a second length of time after rotating the drum in the one direction for the first length of time;

(c) rotating the drum in a reverse direction for a third length of time after the second length of time elapses;

(d) stopping the drum for the second length of time after rotating the drum in the reverse direction for the third length of time, wherein a clockwise and a counterclockwise stirring operation of the drum comprising the operations (a) to (d) is performed at least once to perform a ball distributing cycle of evenly distributing at least some of the plurality of masses in the balancer in a balancer housing, and wherein a force applied to at least one of the plurality of masses by the rotating the drum is counterbalanced by a supporting force applied to the at least one of the plurality of masses by the inclined sidewall of the groove, and wherein a movement of at least one of the plurality of masses in the groove is restricted by a magnetic force produced by the at least one magnet.

2. The method according to claim 1, wherein the ball distributing cycle is performed when the spin-drying cycle starts.

3. The method according to claim 2, further comprising a drainage operation of draining water from a water tub to dry laundry, wherein the ball distributing cycle is performed after the drainage operation.

4. The method according to claim 2, further comprising a weight detection operation of detecting weight of laundry to perform spin-drying of the laundry, wherein the ball distributing cycle is performed before the weight detection operation.

5. The method according to claim 1, wherein, in the rotating of the drum in the one direction, the motor is maintained at certain revolutions per minute (rpm) while being driven in a normal direction for the first length of time.

6. The method according to claim 5, wherein, in the rotating of the drum in the reverse direction, the motor is maintained at the certain rpm while being driven in the reverse direction for the third length of time.

7. The method according to claim 6, wherein the first length of time is equal to the third length of time.

8. The method according to claim 6, wherein the first length of time is set to be longer than the third length of time.

9. The method according to claim 8, wherein the second length of time is set to be shorter than the third length of time.

10. The method according to claim 8, wherein the first length time is about 15 seconds in length.

11. The method according to claim 10, wherein the second length time is longer than or equal to 5 seconds in length.

12. The method according to claim 6, wherein, in the clockwise and counterclockwise stirring operation of the drum, the certain rpm is greater than or equal to 6 rpm.

13. The method according to claim 6, wherein the clockwise and the counterclockwise stirring operation of the drum comprises changing the certain rpm of the motor.

14. The method according to claim 1, wherein the clockwise and the counterclockwise stirring operation of the drum comprises at least one of the first length of time, the second length of time, or the third length of time changing after completion of a first clockwise and first counterclockwise stirring operation.

15. The method according to claim 1, further comprising:

counting a number of times the clockwise and the counterclockwise stirring operation of the drum is performed;

comparing the counted number of times with a predetermined reference number of times of stirring; and stopping the clockwise and the counterclockwise stirring operation of the drum when the number of times the clockwise and the counterclockwise stirring operation is performed is greater than or equal to a reference number.

16. The method according to claim 15, wherein the reference number is greater than or equal to 1.

17. The method according to claim 1, wherein a portion of the inclined sidewall of the groove opposes a sidewall of the groove including a curved portion.

18. The method according to claim 1, wherein an inclination of the inclined sidewall ranges between 5 degrees and 25 degrees.

19. The method according to claim 1, wherein a number of the plurality of masses is greater than a number of the at least one magnet.

* * * * *